US009913059B2

(12) United States Patent
Rosener et al.

(10) Patent No.: US 9,913,059 B2
(45) Date of Patent: Mar. 6, 2018

(54) HEADSET POSITION SENSING, REPORTING, AND CORRECTION

(71) Applicant: Plantronics, Inc., Santa Cruz, CA (US)

(72) Inventors: Douglas K Rosener, Santa Cruz, CA (US); Luis Villasenor, Tijuana (MX)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 15/051,586

(22) Filed: Feb. 23, 2016

(65) Prior Publication Data

US 2017/0245075 A1 Aug. 24, 2017

(51) Int. Cl.

| | |
|---|---|
| ***H04R 1/10*** | (2006.01) |
| ***H04R 1/02*** | (2006.01) |
| ***H04R 29/00*** | (2006.01) |
| *H04R 5/033* | (2006.01) |

(52) U.S. Cl.

CPC ..... *H04R 29/004* (2013.01); *H04R 5/033* (2013.01); *H04R 2201/107* (2013.01); *H04R 2420/07* (2013.01)

(58) Field of Classification Search

CPC ..... H04R 5/033; H04R 5/0335; H04R 5/04; H04R 1/105; H04R 2210/107; H04R 2420/07; H04R 29/004; H04M 1/05; H04M 1/6058

USPC ... 381/26, 74, 362, 370, 374, 375, 379, 384, 381/390, 91, 92, 122; 379/430; 455/575.2

See application file for complete search history.

(56) References Cited

U.S. PATENT DOCUMENTS

| | | | | |
|---|---|---|---|---|
| 7,346,176 | B1 | 3/2008 | Bernardi et al. | |
| 7,457,644 | B1 | 11/2008 | Bobisuthi et al. | |
| 7,920,903 | B2 * | 4/2011 | Ueda | H04M 1/6066 455/569.1 |
| 8,331,603 | B2 * | 12/2012 | Martenson | H04M 1/05 379/430 |
| 8,606,571 | B1 * | 12/2013 | Every | G10L 21/0232 375/285 |
| 8,737,667 | B2 * | 5/2014 | Oh | A61B 5/02438 379/430 |
| 8,942,384 | B2 * | 1/2015 | Lau | H04B 5/0006 381/370 |
| 8,981,969 | B2 * | 3/2015 | Steinmetz | B64D 45/00 340/945 |
| 9,124,975 | B2 * | 9/2015 | Andersen | H04R 1/08 |
| 2005/0129259 | A1 * | 6/2005 | Garner | H04R 1/083 381/172 |
| 2010/0158264 | A1 * | 6/2010 | Marten | H04R 1/1041 381/74 |

(Continued)

*Primary Examiner* — Xu Mei

(74) *Attorney, Agent, or Firm* — Jeremy S. DesRosier

(57) ABSTRACT

A headset having corresponding computer-readable media comprises: a first portion, wherein the first portion comprises a microphone; a second portion, wherein the second portion is rotatably coupled with the first portion; one or more sensors, wherein at least one of the sensors is configured to sense a current difference angle between the first portion and the second portion; a controller configured to generate a message responsive to the current difference angle being outside a range of difference angles, wherein the range of difference angles is associated with acceptable performance of the microphone; wherein the headset is configured to provide the message responsive to the controller generating the message.

20 Claims, 9 Drawing Sheets

(56) References Cited

U.S. PATENT DOCUMENTS

| | | | | |
|---|---|---|---|---|
| 2012/0020491 | A1* | 1/2012 | Dory | H04R 1/1041<br>381/74 |
| 2012/0281850 | A1* | 11/2012 | Hyatt | H04R 1/1041<br>381/74 |

* cited by examiner

HEADSET POSITION SENSING, REPORTING, AND CORRECTION

FIELD

The present disclosure relates generally to the field of headsets. More particularly, the present disclosure relates to the position of a headset as worn by a user.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Headset position is crucial to the audio quality of the headset. There are many variables. For example proper headset position varies from user to user due to variability in head dimensions. And headsets come in several different types. Some headsets have fixed booms and some headsets have a moveable boom. Fixed-boom headsets behave essentially the same as "surfboard" type headsets where the boom is effectively the body of the headset.

One way to achieve proper headset position is to mark the boom to indicate proper boom orientation. Each time before use, the user may use the mark to ensure the boom has the proper orientation. The problem with this solution is that if the headset is worn tilted from the earlier optimization, the setting may be incorrect. This solution also requires the user to examine the headset each time before use, and that is neither desirable nor dependable. Furthermore, if the headset moves, or the boom is bumped out of position, the setting is no longer optimum.

Another solution is to guarantee by design that the headset orientation is always the same when worn. But this solution works only for fixed booms. A fixed boom system also makes it much more difficult to allow for different head shapes, and in addition may cause discomfort.

Another solution is to analyze the user's voice or speech, and if it is non-optimum, warn the user to adjust the headset. This solution requires the user to speak to detect a problem which may waste communication time if it is detected after the communication is started. Also, the user must go through the testing process each time he wants to optimize performance.

SUMMARY

In general, in one aspect, an embodiment features a headset comprising: a first portion, wherein the first portion comprises a microphone; a second portion, wherein the second portion is rotatably coupled with the first portion; one or more sensors, wherein at least one of the sensors is configured to sense a current difference angle between the first portion and the second portion; a controller configured to generate a message responsive to the current difference angle being outside a range of difference angles, wherein the range of difference angles is associated with acceptable performance of the microphone; wherein the headset is configured to provide the message responsive to the controller generating the message.

Embodiments of the headset may include one or more of the following features. Some embodiments comprise a speaker configured to render the message. Some embodiments comprise a transmitter configured to transmit the message from the headset. Some embodiments comprise a motor configured to rotate the first portion with respect to the second portion; wherein the controller is further configured to operate the motor responsive to the current difference angle being outside the range of difference angles. In some embodiments, at least one of the sensors is configured to sense a current angle of the first portion with respect to gravity; the controller is further configured to generate a message responsive to the current angle of the first portion with respect to gravity being outside a range of angles of the first portion with respect to gravity, wherein the range of angles of the first portion with respect to gravity is associated with acceptable performance of the microphone; and the headset is configured to provide the message responsive to the controller generating the message. In some embodiments, subsequent to providing the message and responsive to user input, the headset is further configured to modify the range of boom angles in accordance with the current angle of the boom. In some embodiments, the message is a first message, and the first portion further comprises: a proximity sensor configured to sense a current proximity of a wearer's head; wherein the controller is further configured to generate a second message responsive to the current proximity being outside a range of proximities associated with acceptable performance of the microphone; and wherein the headset is further configured to provide the second message responsive to the controller generating the second message.

In general, in one aspect, an embodiment features computer-readable media embodying instructions executable by a computer in a headset to perform functions comprising: receiving sensor data; determining, based on the sensor data, a current difference angle between a first portion of the headset and a second portion of the headset, wherein the first portion comprises a microphone, and wherein the second portion is rotatably coupled with the first portion; generating a message responsive to the current difference angle being outside a range of difference angles, wherein the range of difference angles is associated with acceptable performance of the microphone; and causing the headset to provide the message.

Embodiments of the computer-readable media may include one or more of the following features. In some embodiments, the functions further comprise: causing a speaker of the headset to render the message. In some embodiments, the functions further comprise: causing a transmitter of the headset to transmit the message from the headset. In some embodiments, the functions further comprise: causing a motor of the headset to rotate the first portion with respect to the second portion responsive to the current difference angle being outside the range of difference angles. In some embodiments, the functions further comprise: determining, based on the sensor data, an angle of the first portion with respect to gravity; generating a message responsive to the current angle of the first portion being outside a range of angles of the first portion, wherein the range of angles of the first portion is associated with acceptable performance of the microphone; and causing the headset to provide the message. In some embodiments, the functions further comprise: subsequent to providing the message and responsive to user input, modifying the range of boom angles in accordance with the current angle of the boom. In some embodiments, the message is a first message, and wherein the functions further comprise: determining, based on the sensor data, a current distance between a wearer's head and the first portion of the headset; generating a second message responsive to the current distance being outside a range of distance associated with acceptable performance of the microphone; and providing the second message.

In general, in one aspect, an embodiment features a headset comprising: a microphone; a boom, wherein the microphone is disposed within the boom; a sensor configured to sense a current angle of the boom with respect to gravity; and a controller configured to generate a message responsive to the current angle of the boom being outside a range of boom angles, wherein the range of boom angles is associated with acceptable performance of the microphone; wherein the headset is configured to provide the message responsive to the controller generating the message. Some embodiments comprise a speaker configured to render the message. Some embodiments comprise a transmitter configured to transmit the message from the headset. Some embodiments comprise an earpiece, wherein the earpiece is rotatably coupled with the boom; and a motor configured to rotate the boom with respect to the earpiece; wherein the controller is further configured to operate the motor responsive to the current angle of the boom being outside the range of boom angles. In some embodiments, subsequent to providing the message and responsive to user input, the headset is further configured to modify the range of boom angles in accordance with the current angle of the boom. In some embodiments, the message is a first message, and the boom further comprises: a proximity sensor configured to sense a current proximity of a wearer's head; wherein the controller is further configured to generate a second message responsive to the current proximity being outside a range of proximities associated with acceptable performance of the microphone; and wherein the headset is further configured to provide the second message responsive to the controller generating the second message.

The details of one or more implementations are set forth in the accompanying drawings and the description below. Other features will be apparent from the description and drawings, and from the claims.

DESCRIPTION OF DRAWINGS

The leading digit(s) of each reference numeral used in this specification indicates the number of the drawing in which the reference numeral first appears.

DETAILED DESCRIPTION

Embodiments of the present disclosure provide headset position sensing, reporting, and correction. Other features are contemplated as well.

FIGS. 1-4 illustrate four different headset types and define angles for each. In the described embodiments all angles are measured with respect to the vertical axis that is parallel to the gravity vector except difference angles, where an angle is measured between two elements of a headset.

Figure 1:
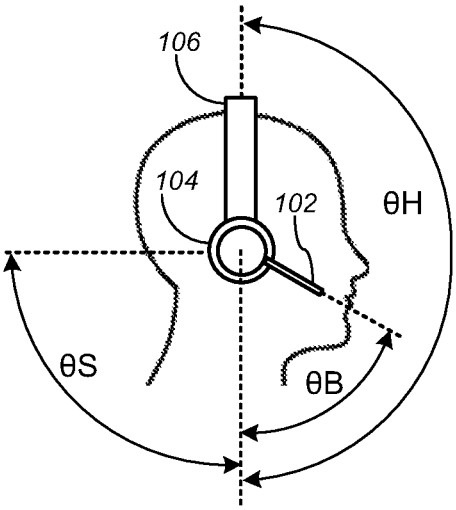
FIG. 1 illustrates a type of headset, referred to herein as "independent," where all three elements of the headset—the boom, speaker, and headband—may move independently of each other.

FIG. 1 illustrates a type of headset, referred to herein as "independent," where all three elements of the headset—the boom 102, speaker 104, and headband 106—may move independently of each other. In an independent headset three angles are defined: the boom angle θB, the speaker angle θS, and the headband angle θH. In addition a difference angle (not shown) θDIFF may be derived, either between the boom 102 and the speaker 104, or between the boom 102 and the headband 106.

Figure 2:
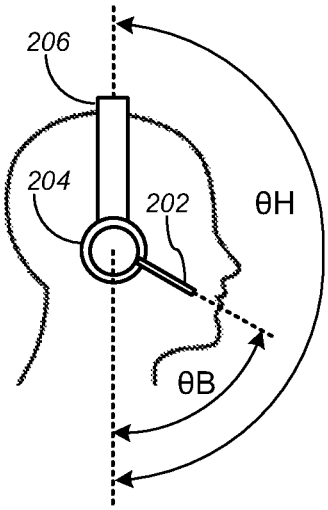
FIG. 2 illustrates a type of headset, referred to herein as "bi-unity," where only two elements of the headset may move independently of one other.

FIG. 2 illustrates a type of headset, referred to herein as "bi-unity," where only two elements of the headset may move independently of one other. In the "bi-unity" headset the speaker 104 is unified with either the boom 102 or the headband 106 so only two angles are defined: the boom angle θB and the headband angle θH. In addition a difference angle (not shown) θDIFF may be derived between the boom 102 and the headband 106 so that for example θDIFF=θB−θH.

Figure 3:
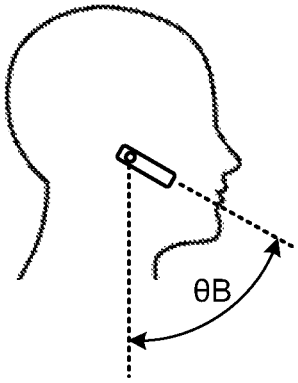
FIG. 3 illustrates a type of headset, referred to herein as "unity," where all elements of the headset are unified.

FIG. 3 illustrates a type of headset, referred to herein as "unity," where all elements of the headset are unified. In the unity headset only one angle is defined: the boom angle θB.

Figure 4:
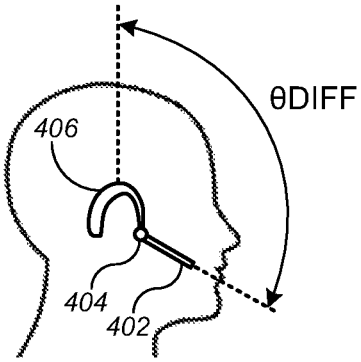
FIG. 4 illustrates a type of headset, referred to herein as "one-way," where the orientation of one element of the headset with respect to the head when worn is always the same.

FIG. 4 illustrates a type of headset, referred to herein as "one-way," where the orientation of one element of the headset with respect to the head when worn is always the same. For example when the headset of FIG. 4 is worn, the speaker 404 goes in the ear canal, and the earloop 406 goes over the ear, in such a way that those elements are always in the same orientation with respect to the head. Only the boom 402 may rotate with respect to the head. Therefore the position of the boom may be determined using the difference angle θDIFF between the earloop and the boom, and the angle of the boom with respect to gravity is not needed. The "one-way" headset type may include other headset configurations as well. For example, a headset with a feature such as a headband that always registers to some landmark of the head such as the crown, neck or the like, may be included. Other examples may include headsets with speakers that always attach to the head in the same position, for example such as oval over-the-ear speakers. Accordingly the difference angle θDIFF should be understood as an angle between the boom 402 and some other element of the headset that can only be worn in one orientation with respect to the head.

Figure 5:
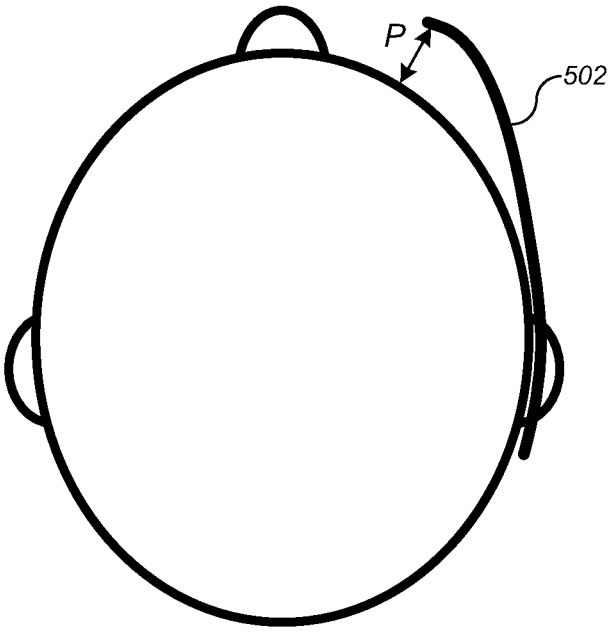
FIG. 5 shows an overhead view of a user wearing a headset with a microphone boom at a distance P from the user's head.

Another factor affecting headset microphone performance is proximity of the microphone to the user's mouth. For both fixed and moveable boom headsets, each time the headset is worn, the headset wearing angle and proximity may be different, so that even if the microphone boom is placed properly with respect to the headset, it may not be properly placed near the user's head. FIG. 5 shows an overhead view of a user wearing a headset with a microphone boom 502 at a distance P from the user's head. Various embodiments measure and employ this distance to attain proper boom position with respect to the user's head.

Figure 6:
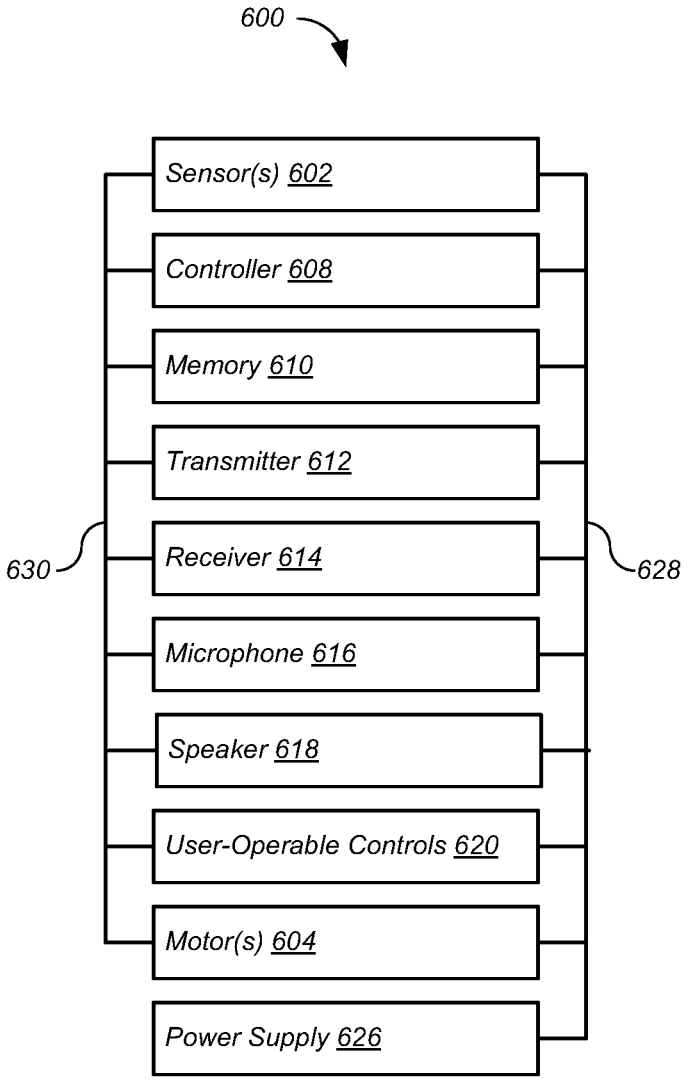
FIG. 6 shows elements of a headset according to one embodiment.

FIG. 6 shows elements of a headset 600 according to one embodiment. Although in the described embodiment elements of the headset 600 are presented in one arrangement, other embodiments may feature other arrangements. For example, various embodiments may lack one or more of the features shown. In addition, elements of the headset 600 may be implemented in hardware, software, or combinations thereof.

Referring to FIG. 6, the headset 600 may include one or more each of sensor(s) 602, motor(s) 604, a controller 608, a memory 610, a transmitter 612, a receiver 614, a microphone 616, a speaker 618, one or more user-operable controls 620, and a power supply 626. The headset 600 may include other elements as well. The elements of headset 600 may receive power from the power supply 626 over one or more power rails 628. Various elements of the headset 600 may be implemented as one or more integrated circuits.

The controller 608 may execute applications stored in the memory 610. The controller 608 may include digital signal controllers, analog-to-digital converters, digital-to-analog converters, and the like. The controller 608 may communicate with other elements of the headset 600 over one or more communication busses 630. The transmitter 612 and receiver 614 may employ any communication protocol, including wired and wireless communication protocols. The wireless protocols may include Bluetooth, Bluetooth Low-Energy (BLE), Wi-Fi, Digital Enhanced Cordless Telecommunications (DECT), cellular, near-field communications (NFC), and the like. The transmitter 612 may employ multiple communication protocols. The user-operable controls 620 may include buttons, slide switches, capacitive sensors, touch screens, and the like.

The sensors 602 may include accelerometers, angle sensors, and the like. For example in a bi-unity headset, an accelerometer may be employed to determine the boom angle θB and an angle sensor may be employed to determine a difference angle θDIFF of the headband relative to the boom. The headband angle θH may then be determined from the boom angle θB and the difference angle θDIFF. Other variations are contemplated.

Any sort of motor 604 may be used. For example, the motor 604 may include materials such as artificial muscle that expand or contract in response to applied electrical signals.

In another example, a conventional electric motor may be used to rotate the boom either linearly or in steps.

Figure 7:
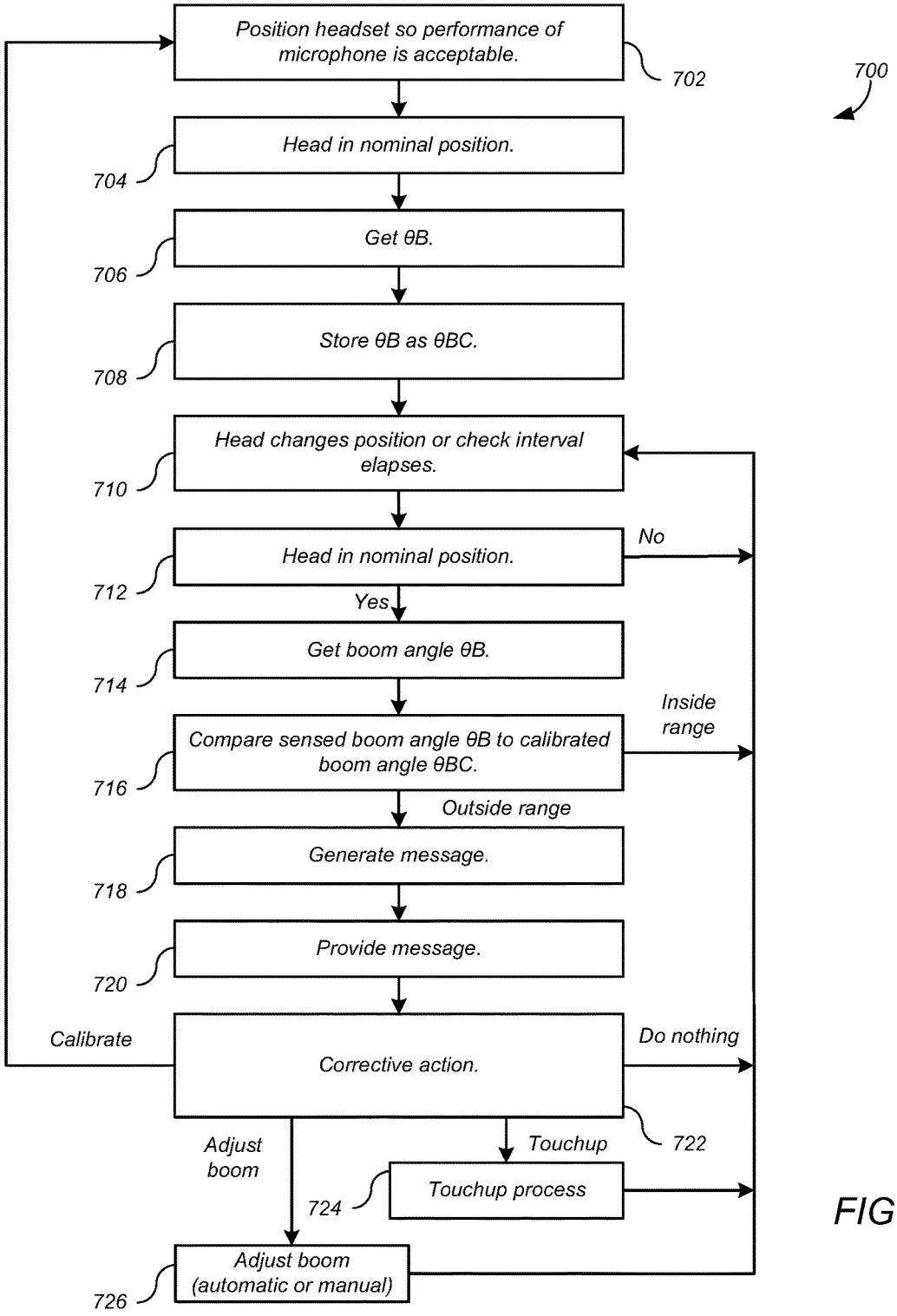
FIG. 7 shows a process for a unity headset such as the headset of FIG. 3 according to one embodiment.

FIGS. 7-10 describe processes for various types of headsets with reference to the elements of the headset 600 of FIG. 6. In some embodiments, elements of these processes may be combined to form other processes. FIG. 7 shows a process 700 for a unity headset such as the headset of FIG. 3 according to one embodiment. Although in the described embodiments the elements of process 700 are presented in one arrangement, other embodiments may feature other arrangements. For example, in various embodiments, some or all of the elements of process 700 may be executed in a different order, concurrently, and the like. Also some elements of process 700 may not be performed, and may not be executed immediately after each other. In addition, some or all of the elements of process 700 may be performed automatically, that is, without human intervention. In some embodiments some functions of the headset 600 may be performed by a device in communication with the headset, for example such as a computer, smartphone, or the like. For example the angles measured by the headset may be sent to the device and stored there. As another example, the device may perform the comparisons and computations described herein.

Referring to FIG. 7, the process 700 may begin with calibration by determining a calibration boom angle θBC. The headset user may initiate calibration, for example by operating one of the user-operable controls 620 on the headset 600, by providing a voice command, by operating a soft button on a display of a computer or smartphone, or the like. The headset may initiate calibration automatically when donned, for example responsive to input from a don/doff detector.

At 702, the headset user may position the headset 600 so the performance of the microphone is acceptable. Any method can be used. For example, the user may put point the headset 600 at the mouth. Alternatively the user may have another person evaluate the boom position. One other possibility is for the user to wear the headset 600 and test the headset position using an application that measures transmit voice quality. One such method is disclosed in U.S. Pat. No. 7,561,700.

At 704 the user may position his head in a nominal position, that is, a normal working position for the user, for example by gazing at a computer monitor, smartphone screen, or the like. In some embodiments, the user is prompted to position his head in nominal position. In some embodiments, nominal position is detected by one or more sensor which may be located within the headset 600, outside the headset 600, or both. In some embodiments, the head may be assumed to be in nominal position when the user is looking at a computer screen, which can be detected for example by a background program running on a computer, pad, or smartphone that detects when the user is typing or touching the screen. The computer can then send a message to inform the headset of nominal head position. Alternatively in embodiments where the boom angles are streamed to a computer, the background program can perform the checking.

In any case, when the user's head is in nominal position, the headset may get the current boom angle θB, at 706. That is one or more of the headset sensors 602 may sense the current boom angle θB. For example the sensors 602 may include an accelerometer that senses the current boom angle θB. In some embodiments, the average of several current boom angles may be used to avoid nuisance warnings. At 708, the headset 600 may store the current boom angle θB as the calibration boom angle θBC in the headset memory 610.

Subsequent to calibration, the headset may check the current boom angle θB and may compare θB to the calibration boom angle θBC. At 710, these checks may occur at selected intervals, when the head changes position, and the like. Then when the head is in the nominal position at 712, the headset may get the current boom angle θB at 714 and may compare the current boom angle θB to the calibration boom angle θBC, at 716. In particular, the controller 608 may determine whether the current boom angle θB is outside a range of boom angles associated with acceptable performance of the microphone 616. The range of angles may be based on the calibration boom angle θBC. The range may be selected so as to avoid nuisance alarms while still detecting significant errors. Responsive to the current boom angle θB being inside the range of boom angles, the process 700 may resume the check routine, at 710.

Responsive to the current difference angle θB being outside the range of difference angles, the controller 608 may generate a message, at 718. At 720, responsive to the controller 608 generating the message, the headset 600 may provide the message. In some embodiments, the headset speaker 618 may render the message for the user. In some embodiments, the headset transmitter 612 may transmit the message from the headset 600. For example, the message may be sent to a computer or smartphone which then renders the message for the user. The message may include information that represents one or more of the current boom angle θB and the calibration boom angle θBC. In other embodiments, the controller 608 may pass the angles to another unit such as a phone or computer that implements these functions.

At 722, corrective action may be taken. In particular, the user may return to calibration, adjust the boom, initiate a touchup process, or do nothing. The headset user may make a selection, for example by operating one of the user-operable controls 620 on the headset 600, by providing a voice command, by operating a soft button on a display of a computer or smartphone, or the like. Responsive to the user selecting calibration, the process returns to calibration, at 702. Responsive to the user electing to do nothing, the headset returns to checking the boom angle θB, at 710. Responsive to the user electing to adjust the boom, at 726, the boom may be adjusted, either manually by the user, or automatically by a motor 604 in the headset, with the headset then returning to checking the boom angle θB, at 710. Responsive to the user selecting touchup, at 724, a touchup process is initiated. In particular, the headset 600 may store the current boom angle θB as the calibration boom angle θBC in the headset memory 610. The headset then returns to checking the boom angle θB, at 710. For unity headsets, tilting the head for extended periods could lead to false alarms. To reduce false alarms, in some embodiments, the message and corrective action may be employed only after the current boom angle θB is outside the range of boom angles for a predetermined period of time.

Figure 8A:
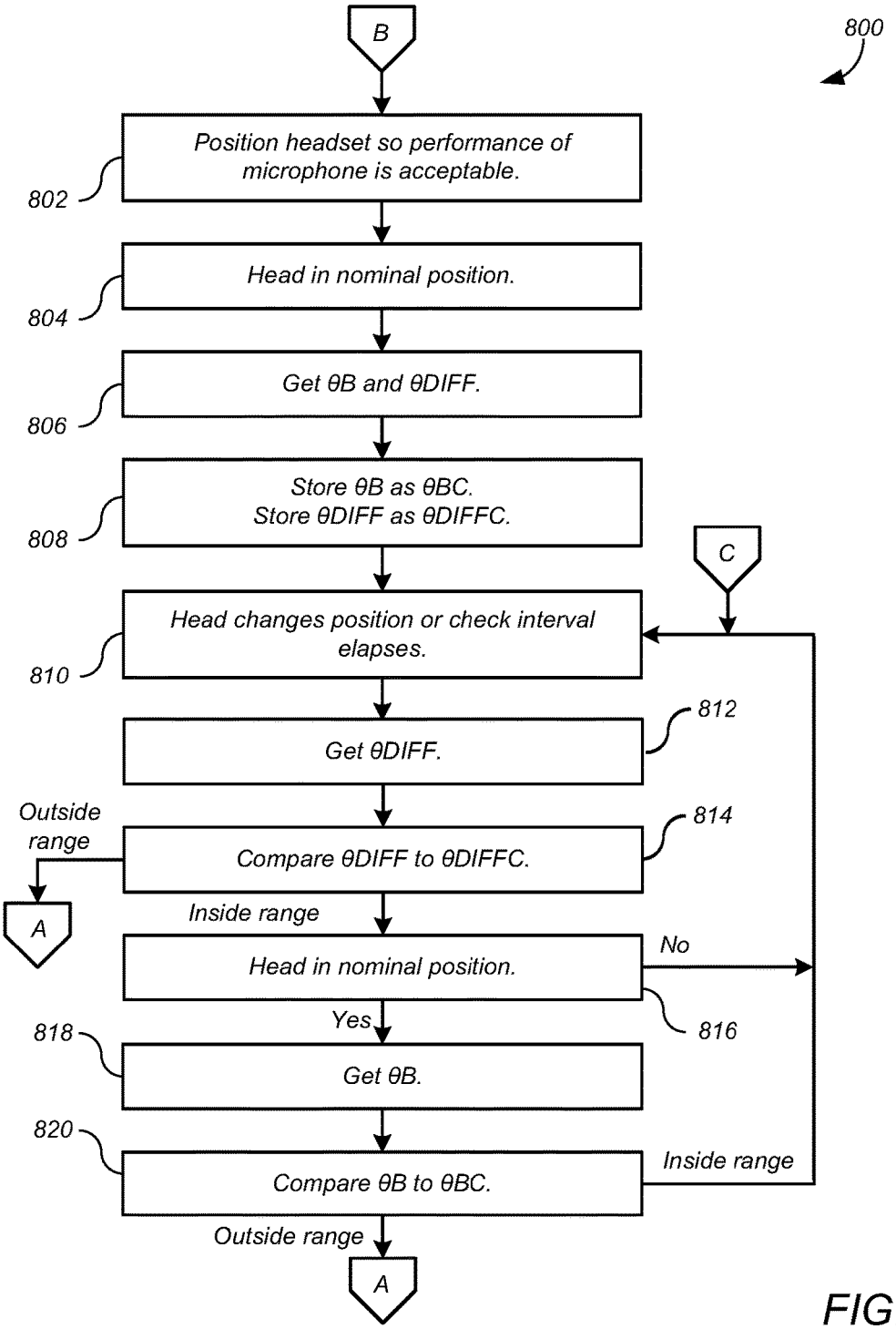
FIGS. 8A and 8B show a process for a bi-unity headset such as the headset of FIG. 2 or an independent headset such as the headset of FIG. 1 according to one embodiment.
Figure 8B:
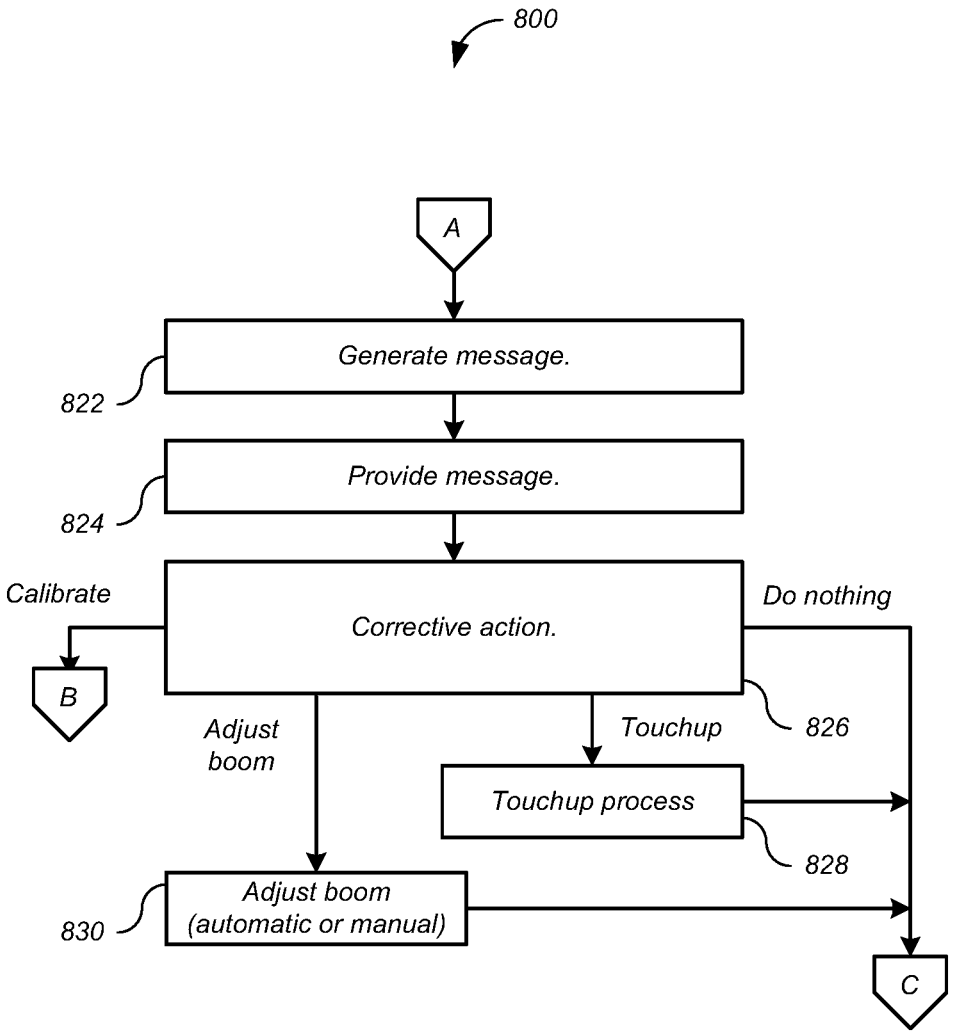

FIGS. 8A and 8B show a process 800 for a bi-unity headset such as the headset of FIG. 2 or an independent headset such as the headset of FIG. 1 according to one embodiment. Although in the described embodiments the elements of process 800 are presented in one arrangement, other embodiments may feature other arrangements. For example, in various embodiments, some or all of the elements of process 800 may be executed in a different order, concurrently, and the like. Also some elements of process 800 may not be performed, and may not be executed immediately after each other. In addition, some or all of the elements of process 800 may be performed automatically, that is, without human intervention. In some embodiments some functions of the headset 600 may be performed by a device in communication with the headset, for example such as a computer, smartphone, or the like. For example the angles measured by the headset may be sent to the device and stored there. As another example, the device may perform the comparisons and computations described herein.

Referring to FIGS. 8A and 8B, the process 800 may begin with calibration by determining a calibration boom angle θBC and a calibration difference angle θDIFFC. The headset user may initiate calibration, for example by operating one of the user-operable controls 620 on the headset 600, by providing a voice command, by operating a soft button on a display of a computer or smartphone, or the like. The headset may initiate calibration automatically when donned, for example responsive to input from a don/doff detector.

At 802, the headset user may position the headset 600 so the performance of the microphone is acceptable. Any method can be used. For example, the user may put point the headset 600 at the mouth. Alternatively the user may have another person evaluate the boom position. One other possibility is for the user to wear the headset 600 and test the headset position using an application that measures transmit voice quality. One such method is disclosed in U.S. Pat. No. 7,561,700.

At 804 the user may position his head in a nominal position, that is, a normal working position for the user, for example by gazing at a computer monitor, smartphone screen, or the like. In some embodiments, the user is prompted to position his head in nominal position. In some embodiments, nominal position is detected by one or more sensors which may be located within the headset 600, outside the headset 600, or both. In some embodiments, the head may be assumed to be in nominal position when the user is looking at a computer screen, which can be detected for example by a background program running on a computer, pad, or smartphone that detects when the user is typing or touching the screen. The computer can then send a message to inform the headset of nominal head position. Alternatively in embodiments where the boom angles are streamed to a computer, the background program can perform the checking.

In any case, when the user's head is in nominal position, the headset may get the current boom angle θB and the current difference angle θDIFF, at 806. That is, one or more of the headset sensors 602 may sense angles θB and θDIFF. For example the sensors 602 may include an accelerometer that senses the current boom angle θB and an angle sensor that sense the current difference angle θDIFF. As another example θDIFF may be calculated as a difference between the measurements of two accelerometers. In some embodiments, the average of several angles may be used to avoid nuisance warnings. At 808, the headset 600 may store the current boom angle θB and the current difference angle θDIFF as the calibration boom angle θBC and the calibration difference angle θDIFFC in the headset memory 610.

The difference angle θDIFF is an angle between the boom and another element of the headset. For example in the independent headset of FIG. 1, θDIFF may be the angle between the boom 102 and the speaker 104 such that θDIFF=θB−θS, or between the boom 102 and the headband 106 such that θDIFF=θB−θH. As another example in the bi-unity headset of FIG. 2, θDIFF may be the angle between the boom 202 and the headband 206 such that θDIFF=θB−θH. Other arrangements are contemplated.

Subsequent to calibration, the headset may check the current difference angle θDIFF and may compare θDIFF to the calibration difference angle θDIFFC. At 810, these checks may occur at selected intervals, when the head changes position, and the like. Then the headset may get the current difference angle θDIFF at 812 and may compare the current difference angle θDIFF to the calibration difference angle θDIFFC, at 814. In particular, the controller 608 may determine whether the current difference angle θDIFF is outside a range of difference angles associated with acceptable performance of the microphone 616. The range of angles may be based on the calibration difference angle θDIFFC. The range may be selected so as to avoid nuisance alarms while still detecting significant errors.

Responsive to the current difference angle θDIFF being outside the range of difference angles, the controller 608 may generate a message, at 822. At 824, responsive to the controller 608 generating the message, the headset 600 may provide the message. In some embodiments, the headset speaker 618 may render the message for the user. In some embodiments, the headset transmitter 612 may transmit the message from the headset 600. For example, the message may be sent to a computer or smartphone which then renders the message for the user. The message may include information that represents one or more of the current boom angle θB, the calibration boom angle θBC, the current difference angle θDIFF, and the calibration difference angle θDIFFC. In other embodiments, the controller 608 may pass the angles to another unit such as a phone or computer that implements these functions.

At 826, corrective action may be taken. In particular, the user may return to calibration, adjust the boom, initiate a touchup process, or do nothing. The headset user may make a selection, for example by operating one of the user-operable controls 620 on the headset 600, by providing a voice command, by operating a soft button on a display of a computer or smartphone, or the like. Responsive to the user selecting calibration, the process returns to calibration, at 802. Responsive to the user electing to do nothing, the headset returns to checking the difference angle θDIFF, at 810. Responsive to the user electing to adjust the boom, at 830, the boom may be adjusted, either manually by the user, or automatically by a motor 604 in the headset, with the headset then returning to checking the difference angle θDIFF, at 810. Responsive to the user selecting touchup, at 828, a touchup process is initiated. In particular, the headset 600 may store the current boom angle θB as the calibration boom angle θBC in the headset memory 610. The headset then returns to checking the difference angle θDIFF, at 810. To reduce false alarms, in some embodiments, the message and corrective action may be employed only after the current boom angle θB or the current difference angle θDIFF, is outside the range of boom angles for a predetermined period of time.

Alternatively, responsive to the current difference angle θDIFF being inside the range of difference angles, at 814, the headset may check the boom angle θB, at 818, if the head is in the nominal position, at 816. If the head is not in the nominal position at 816, then the process 800 may resume checking the difference angle θDIFF, at 810. But when the head is in the nominal position, at 816, the headset may get the current boom angle θB at 818 and may compare the current boom angle θB to the calibration boom angle θBC, at 820. In particular, the controller 608 may determine whether the current boom angle θB is outside a range of boom angles associated with acceptable performance of the microphone 616. The range of angles may be based on the calibration boom angle θBC. The range may be selected so as to avoid nuisance alarms while still detecting significant errors. Responsive to the current boom angle θB being inside the range of boom angles, the process 800 may resume checking the difference angle θDIFF, at 810.

Alternatively, at 820, responsive to the current boom angle θB being outside the range of headset angles, the controller 608 may generate a message, at 822. At 824, responsive to the controller 608 generating the message, the headset 600 may provide the message. In some embodiments, the headset speaker 618 may render the message for the user. In some embodiments, the headset transmitter 612 may transmit the message from the headset 600. For example, the message may be sent to a computer or smartphone which then renders the message for the user. The message may include information that represents one or more of the current boom angle θB, the calibration boom angle θBC, the current difference angle θDIFF, and the calibration difference angle θDIFFC. At 826, corrective action may be taken as described above.

Figure 9:
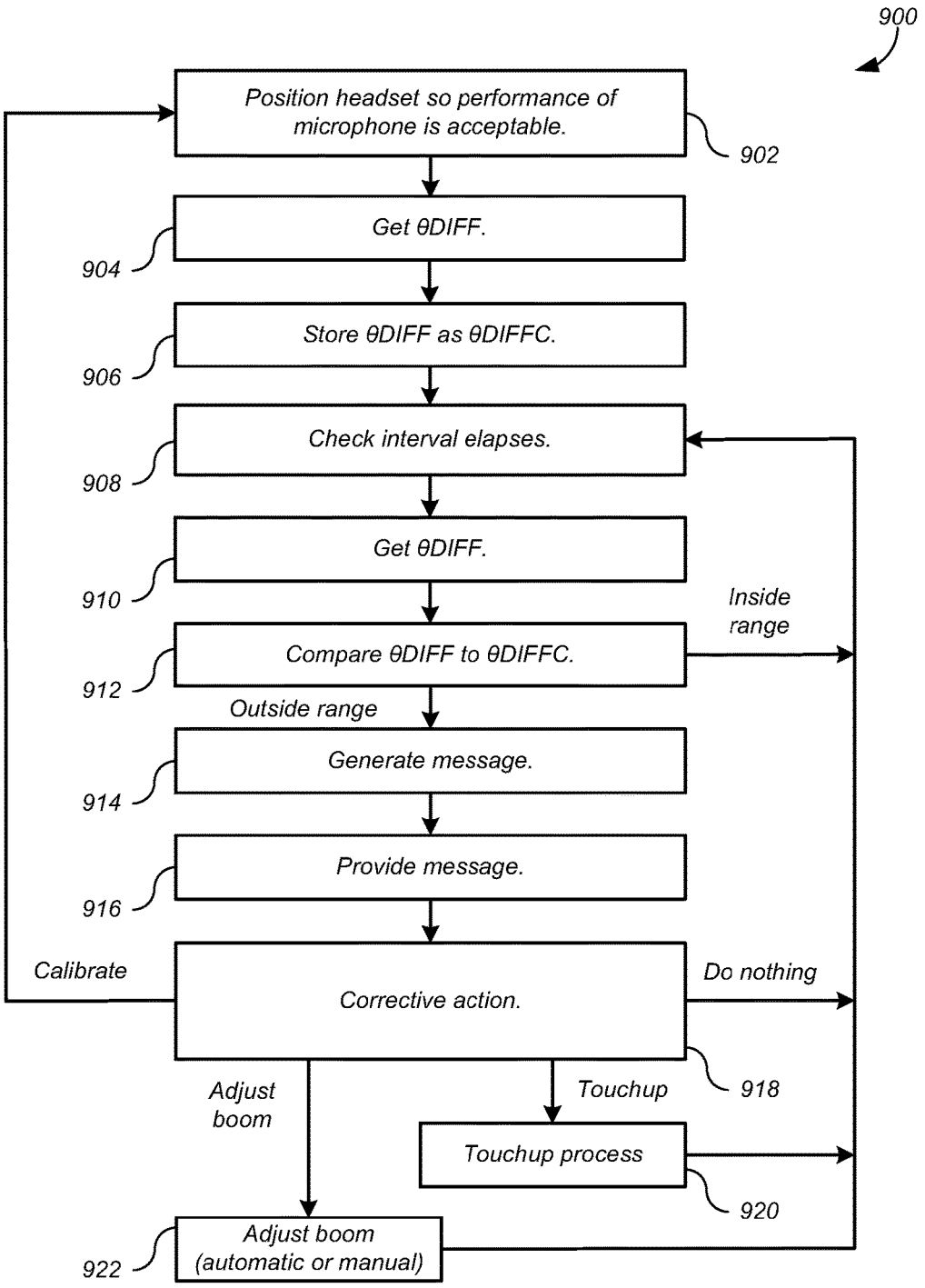
FIG. 9 shows a process for a one-way headset such as the headset of FIG. 4 according to one embodiment.

FIG. 9 shows a process 900 for a one-way headset such as the headset of FIG. 4 according to one embodiment. Although in the described embodiments the elements of process 900 are presented in one arrangement, other embodiments may feature other arrangements. For example, in various embodiments, some or all of the elements of process 900 may be executed in a different order, concurrently, and the like. Also some elements of process 900 may not be performed, and may not be executed immediately after each other. In addition, some or all of the elements of process 900 may be performed automatically, that is, without human intervention. In some embodiments some functions of the headset 600 may be performed by a device in communication with the headset, for example such as a computer, smartphone, or the like. For example the angles measured by the headset may be sent to the device and stored there. As another example, the device may perform the comparisons and computations described herein.

Referring to FIG. 9, the process 900 may begin with calibration by determining a calibration difference angle θDIFFC. The headset user may initiate calibration, for example by operating one of the user-operable controls 620 on the headset 600, by providing a voice command, by operating a soft button on a display of a computer or smartphone, or the like. The headset may initiate calibration automatically when donned, for example responsive to input from a don/doff detector.

At 902, the headset user may position the headset 600 so the performance of the microphone is acceptable. Any method can be used. For example, the user may put point the headset 600 at the mouth. Alternatively the user may have another person evaluate the boom position. One other possibility is for the user to wear the headset 600 and test the headset position using an application that measures transmit voice quality. One such method is disclosed in U.S. Pat. No. 7,561,700.

At 904, the headset may get the current difference angle θDIFF. That is, one or more of the headset sensors 602 may sense angle θDIFF. For example the sensors 602 may include accelerometers or an angle sensor that senses the current difference angle θDIFF. In some embodiments, the average of several angles may be used to avoid nuisance warnings. At 906, the headset 600 may store the current difference angle θDIFF as the calibration difference angle θDIFFC in the headset memory 610.

The difference angle θDIFF is an angle between the boom and another element of the headset. For example in the one-way headset of FIG. 4, θDIFF may be the angle between the boom 402 and the earloop 406. Other arrangements are contemplated.

Subsequent to calibration, the headset may check the current difference angle θDIFF and may compare θDIFF to the calibration difference angle θDIFFC. At 908, these checks may occur at selected intervals. Then the headset may get the current difference angle θDIFF, at 910, and may compare the current difference angle θDIFF to the calibration difference angle θDIFFC, at 912. In particular, the controller 608 may determine whether the current difference angle θDIFF is outside a range of difference angles associated with acceptable performance of the microphone 616. The range of angles may be based on the calibration difference angle θDIFFC. The range may be selected so as to avoid nuisance alarms while still detecting significant errors.

Responsive to the current difference angle θDIFF being outside the range of difference angles, the controller 608 may generate a message, at 914. At 916, responsive to the controller 608 generating the message, the headset 600 may provide the message. In some embodiments, the headset speaker 618 may render the message for the user. In some embodiments, the headset transmitter 612 may transmit the message from the headset 600. For example, the message may be sent to a computer or smartphone which then renders the message for the user. The message may include information that represents one or more of the current difference angle θDIFF and the calibration difference angle θDIFFC. In other embodiments, the controller 608 may pass the angles to another unit such as a phone or computer that implements these functions.

At 918, corrective action may be taken. In particular, the user may return to calibration, adjust the boom, initiate a touchup process, or do nothing. The headset user may make a selection, for example by operating one of the user-operable controls 620 on the headset 600, by providing a voice command, by operating a soft button on a display of a computer or smartphone, or the like. Responsive to the user selecting calibration, the process returns to calibration, at 902. Responsive to the user electing to do nothing, the headset returns to checking the difference angle θDIFF at 908. Responsive to the user electing to adjust the boom, at 922, the boom may be adjusted, either manually by the user, or automatically by a motor 604 in the headset, with the headset then returning to checking the difference angle θDIFF, at 908. Responsive to the user selecting touchup, at 920, a touchup process is initiated. In particular, the headset 600 may store the current difference angle θDIFF as the calibration difference angle θDIFFC in the headset memory 610. The headset then returns to checking the difference angle θDIFF at 908. To reduce false alarms, in some embodiments, the message and corrective action may be employed only after the current difference angle θDIFF is outside the range of difference angles for a predetermined period of time.

Figure 10:
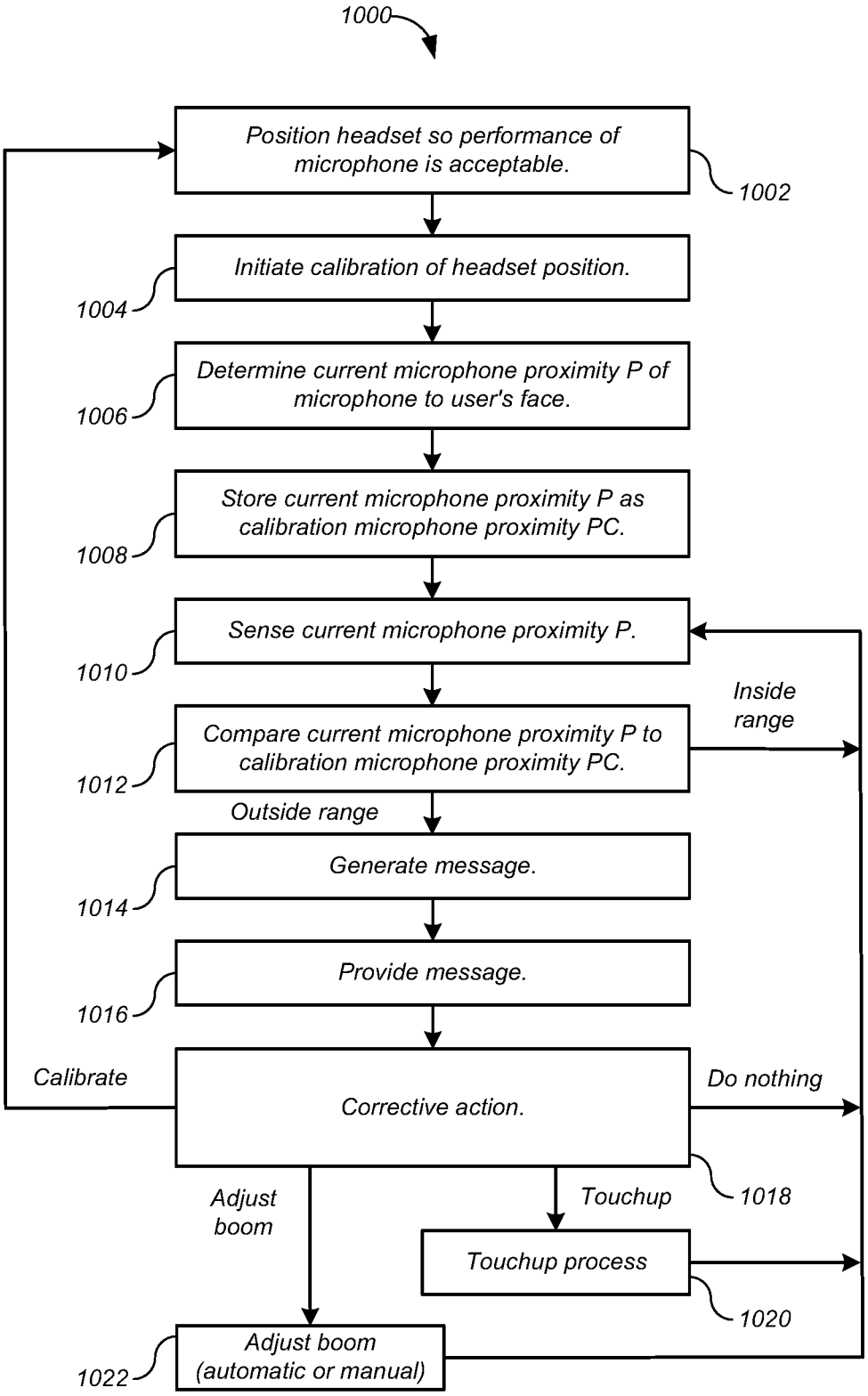
FIG. 10 shows a process for sensing, reporting and correcting microphone proximity for a headset according to one embodiment.

Another factor affecting headset microphone performance is proximity of the microphone to the user's mouth. For both fixed and moveable boom headsets, each time the headset is worn, the headset wearing angle and proximity may be different, so that even if the microphone boom is placed properly with respect to the headset, it may not be properly placed near the user's head. FIG. 10 shows a process 1000 for sensing, reporting and correcting microphone proximity for a headset 600 according to one embodiment. Process 1000 can be used for any headset, and may be used alone or in combination with other processes disclosed herein. For example it may be preferable to set the correct boom angle before setting the correct proximity.

Although in the described embodiments the elements of process 1000 are presented in one arrangement, other embodiments may feature other arrangements. For example, in various embodiments, some or all of the elements of process 1000 may be executed in a different order, concurrently, and the like. Also some elements of process 1000 may not be performed, and may not be executed immediately after each other. In addition, some or all of the elements of process 1000 may be performed automatically, that is, without human intervention.

Referring to FIG. 10, at 1002, the headset user may position the headset 600 so the performance of the microphone is acceptable. Any method can be used. For example, the user may put the microphone boom tip two finger widths from the side of the mouth. Alternatively the user may have another person evaluate the boom position. One other possibility is for the user to wear the headset 600 and test the boom position using an application that measures transmit voice quality.

At 1004, the headset user may initiate calibration of the headset position, for example by operating one of the user-operable controls 620 on the headset 600, by providing a voice command, by operating a soft button on a display of a computer or smartphone, or the like. The headset may initiate calibration automatically when donned, for example responsive to input from a don/doff detector. In response, at 1006, the headset 600 may determine the current microphone proximity P of the microphone 616 of the headset 600 to the user's face as measured by one or more sensors 602 of the headset 600 and as illustrated in FIG. 5. At 1008, the headset 600 may store that proximity P as the calibration microphone proximity PC in the headset memory 610. Any proximity sensor(s) 602 may be used. For example, the proximity sensor(s) 602 may include infrared sensors, ultrasound sensors, and the like.

Subsequent to calibration, at 1010, one or more sensors 602 of the headset 600 may sense the current microphone proximity P, at regular intervals or on user demand. At 1012, the controller 608 may compare the current microphone proximity P to the calibration microphone proximity PC. In particular, the controller 608 may determine whether the current microphone proximity P is outside a range of microphone proximities associated with acceptable performance of the microphone 616, where the range of microphone proximities is based on the calibration microphone proximity PC. The range may be selected so as to avoid nuisance alarms while still detecting significant errors. Responsive to the current microphone proximity P being inside the range of microphone proximities, the headset 600 may return to sensing the current microphone proximity P, at 1010.

Alternatively, at 1012, responsive to the current microphone proximity P being outside the range of microphone proximities, the controller 608 may generate a message. At 1014, responsive to the controller 608 generating the message, the headset 600 may provide the message.

In some embodiments, the headset speaker 618 may render the message for the user. In some embodiments, the transmitter 612 may transmit the message from the headset 600. For example, the message may be sent to a computer or smartphone which then renders the message for the user. The message may include information that represents the current microphone proximity P. The headset 600 may then return to calibration, at 1002.

At 1018, corrective action may be taken. In particular, the user may return to calibration, adjust the boom, initiate a touchup process, or do nothing. The headset user may make a selection, for example by operating one of the user-operable controls 620 on the headset 600, by providing a voice command, by operating a soft button on a display of a computer or smartphone, or the like. Responsive to the user selecting calibration, the process returns to calibration, at 1002. Responsive to the user electing to do nothing, the headset returns to checking the microphone proximity P at 1010. Responsive to the user electing to adjust the boom, at 1022, the boom may be adjusted, either manually by the user, or automatically by a motor 604 in the headset, with the headset then returning to checking the microphone proximity P, at 1010. Responsive to the user selecting touchup, at 1020, a touchup process is initiated. In particular, the headset 600 may store the current microphone proximity P as the calibration microphone proximity PC in the headset memory 610. The headset then returns to checking the microphone proximity P at 1010. To reduce false alarms, in some embodiments, the message and corrective action may be employed only after the current microphone proximity P is outside the range of microphone proximities for a predetermined period of time.

In some embodiments some functions of the headset 600 may be performed by a device in communication with the headset, for example such as a computer, smartphone, or the like. For example the angles measured by the headset may be sent to the device and stored there. As another example, the device may perform the comparisons and computations described herein.

In some embodiments, a display screen of a computer, smartphone, or the like may be employed in the processes described herein. For clarity, these embodiments are now described with reference to a personal computer having a display screen, mouse and keyboard. However any computing device with a display and one or more input/output devices may be used.

Figure 11:
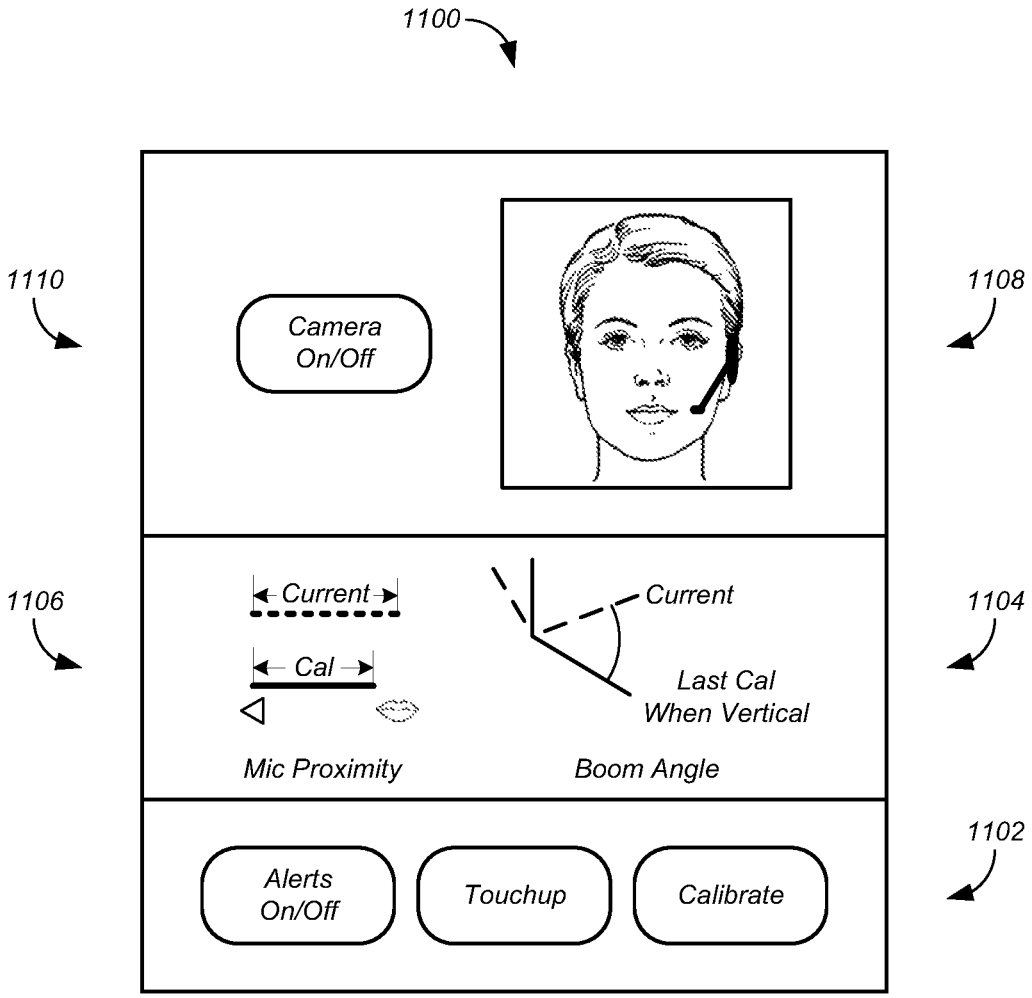
FIG. 11 shows a display for headset positioning according to one embodiment.

FIG. 11 shows a display for headset positioning 1100 according to one embodiment.

The display 1100 may be rendered automatically for the user when the headset 600 generates a message responsive to headset misalignment. Alternatively a headset icon in the system tray may be modified when the headset 600 generates a message responsive to headset misalignment. For example the headset icon may be green and upright when the headset 600 is properly aligned, and may be shown as red and sideways when the headset is misaligned. In these embodiments the user may access the display 1100 by clicking on the headset icon. The headset icon may provide an indication of the degree of headset misalignment.

The display 1100 may include buttons 1102 the user may operate to initiate calibration or touch-up, or to turn on and off alert messages. The display 1100 may include a graphical indicator 1104 for the boom angle and a graphical indicator 1106 for microphone (mic) proximity that allow the user to visualize the current and calibration boom angles and microphone proximities. The display 1100 may include a feed 1108 from the user's computer camera and a button 1110 that allows the user to turn the camera on and off. In some embodiments, one or both of the graphical indicators 1104, 1106 may be superimposed on the camera feed 1108.

Various embodiments of the present disclosure may be implemented in digital electronic circuitry, or in computer hardware, firmware, software, or in combinations thereof. Embodiments of the present disclosure may be implemented in a computer program product tangibly embodied in a computer-readable storage device for execution by a programmable processor. The described processes may be performed by a programmable processor executing a program of instructions to perform functions by operating on input data and generating output. Embodiments of the present disclosure may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, processors receive instructions and data from a read-only memory and/or a random access memory. Generally, a computer includes one or more mass storage devices for storing data files. Such devices include magnetic disks, such as internal hard disks and removable disks, magneto-optical disks; optical disks, and solid-state disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing may be supplemented by, or incorporated in, ASICs (application-specific integrated circuits). As used herein, the term "module" may refer to any of the above implementations.

A number of implementations have been described. Nevertheless, various modifications may be made without departing from the scope of the disclosure. Accordingly, other implementations are within the scope of the following claims.

What is claimed is:

1. A headset comprising:

a first portion, wherein the first portion comprises a microphone;

a second portion, wherein the second portion is rotatably coupled with the first portion;

one or more sensors, wherein at least one of the sensors is configured to sense a current difference angle between the first portion and the second portion;

a controller configured to generate a message responsive to the current difference angle being outside a range of difference angles, wherein the range of difference angles is associated with acceptable performance of the microphone;

wherein the headset is configured to provide the message responsive to the controller generating the message.

2. The headset of claim 1, further comprising:

a speaker configured to render the message.

3. The headset of claim 1, further comprising:

a transmitter configured to transmit the message from the headset.

4. The headset of claim 1, further comprising:

a motor configured to rotate the first portion with respect to the second portion;

wherein the controller is further configured to operate the motor responsive to the current difference angle being outside the range of difference angles.

5. The headset of claim 1, wherein:

at least one of the sensors is configured to sense a current angle of the first portion with respect to gravity;

the controller is further configured to generate a message responsive to the current angle of the first portion with respect to gravity being outside a range of angles of the first portion with respect to gravity, wherein the range of angles of the first portion with respect to gravity is associated with acceptable performance of the microphone; and the headset is configured to provide the message responsive to the controller generating the message.

6. The headset of claim 1 wherein:

subsequent to providing the message and responsive to user input, the headset is further configured to modify the range of boom angles in accordance with the current angle of the boom.

7. The headset of claim 1, wherein the message is a first message, and wherein the first portion further comprises:

a proximity sensor configured to sense a current proximity of a wearer's head;

wherein the controller is further configured to generate a second message responsive to the current proximity being outside a range of proximities associated with acceptable performance of the microphone; and wherein the headset is further configured to provide the second message responsive to the controller generating the second message.

8. A non-transitory computer-readable media embodying instructions executable by a computer in a headset to perform functions comprising:

receiving sensor data;

determining, based on the sensor data, a current difference angle between a first portion of the headset and a second portion of the headset, wherein the first portion comprises a microphone, and wherein the second portion is rotatably coupled with the first portion;

generating a message responsive to the current difference angle being outside a range of difference angles, wherein the range of difference angles is associated with acceptable performance of the microphone; and causing the headset to provide the message.

9. The computer-readable media of claim 8, wherein the functions further comprise:

causing a speaker of the headset to render the message.

10. The computer-readable media of claim 8, wherein the functions further comprise:

causing a transmitter of the headset to transmit the message from the headset.

11. The computer-readable media of claim 8, wherein the functions further comprise:

causing a motor of the headset to rotate the first portion with respect to the second portion responsive to the current difference angle being outside the range of difference angles.

12. The computer-readable media of claim 8, wherein the functions further comprise:

determining, based on the sensor data, an angle of the first portion with respect to gravity;

generating a message responsive to the current angle of the first portion being outside a range of angles of the first portion, wherein the range of angles of the first portion is associated with acceptable performance of the microphone; and causing the headset to provide the message.

13. The computer-readable media of claim 8, wherein the functions further comprise:

subsequent to providing the message and responsive to user input, modifying the range of boom angles in accordance with the current angle of the boom.

14. The computer-readable media of claim 8, wherein the message is a first message, and wherein the functions further comprise:

determining, based on the sensor data, a current distance between a wearer's head and the first portion of the headset;

generating a second message responsive to the current distance being outside a range of distance associated with acceptable performance of the microphone; and providing the second message.

15. A headset comprising:

a microphone;

a boom, wherein the microphone is disposed within the boom;

a sensor configured to sense a current angle of the boom with respect to gravity; and a controller configured to generate a message responsive to the current angle of the boom being outside a range of boom angles, wherein the range of boom angles is associated with acceptable performance of the microphone;

wherein the headset is configured to provide the message responsive to the controller generating the message.

16. The headset of claim 15, further comprising:

a speaker configured to render the message.

17. The headset of claim 15, further comprising:

a transmitter configured to transmit the message from the headset.

18. The headset of claim 15, further comprising:

an earpiece, wherein the earpiece is rotatably coupled with the boom; and a motor configured to rotate the boom with respect to the earpiece;

wherein the controller is further configured to operate the motor responsive to the current angle of the boom being outside the range of boom angles.

19. The headset of claim 15, wherein:

subsequent to providing the message and responsive to user input, the headset is further configured to modify the range of boom angles in accordance with the current angle of the boom.

20. The headset of claim 15, wherein the message is a first message, and wherein the boom further comprises:

a proximity sensor configured to sense a current proximity of a wearer's head;

wherein the controller is further configured to generate a second message responsive to the current proximity being outside a range of proximities associated with acceptable performance of the microphone; and wherein the headset is further configured to provide the second message responsive to the controller generating the second message.

* * * * *